US010196860B2

(12) United States Patent
Wright

(10) Patent No.: US 10,196,860 B2
(45) Date of Patent: Feb. 5, 2019

(54) TELESCOPIC MINI-RIG

(71) Applicant: David C. Wright, Spring, TX (US)

(72) Inventor: David C. Wright, Spring, TX (US)

( * ) Notice: Subject to any disclaimer, the term of this patent is extended or adjusted under 35 U.S.C. 154(b) by 137 days.

(21) Appl. No.: 14/857,707

(22) Filed: Sep. 17, 2015

(65) Prior Publication Data

US 2016/0076310 A1 Mar. 17, 2016

Related U.S. Application Data

(60) Provisional application No. 62/051,753, filed on Sep. 17, 2014.

(51) Int. Cl.
*E21B 15/00* (2006.01)

(52) U.S. Cl.
CPC ..... *E21B 15/003* (2013.01)

(58) Field of Classification Search
CPC ..... E21B 19/02; E21B 7/02
See application file for complete search history.

(56) References Cited

U.S. PATENT DOCUMENTS 2,923,381 A * 2/1960 Wilkinson ..... E04H 12/34 52/115
3,257,099 A 6/1966 Merritt, Jr.
3,721,054 A * 3/1973 Hornagold ..... B66C 23/701 52/115
3,802,137 A 4/1974 Armstrong
3,942,593 A 3/1976 Reeve, Jr. et al.
3,949,883 A 4/1976 Crooke et al.
4,170,340 A 10/1979 Mouton, Jr.
4,208,158 A * 6/1980 Davies ..... E21B 15/003 175/85
4,269,395 A 5/1981 Newman et al.
4,437,515 A 3/1984 Boyadjieff et al.
4,465,131 A 8/1984 Boyadijieff et al.
4,479,547 A 10/1984 Boyadjieff et al.
4,585,213 A 4/1986 Slagle, Jr. et al.
4,676,312 A 6/1987 Mosing et al.
4,837,992 A 6/1989 Hashimoto
5,248,005 A 9/1993 Mochizuki
5,265,683 A 11/1993 Krasnov
6,435,280 B1 * 8/2002 Van Wechem ..... E21B 19/16 166/377

(Continued)

*Primary Examiner* — David J Bagnell
*Assistant Examiner* — Brandon M Duck

(57) ABSTRACT

A system and method are usable as a telescoping, small-scale oil rig, having the ability to rotate tubulars in a wellbore, pull tubulars from the wellbore, and insert tubulars into the wellbore. The system comprises a telescopic derrick section, a casing jack platform, and a base section. The telescopic derrick comprises U-shaped substructure frames that can be nested together, and is connected to an adjacent substructure through hydraulic cylinders. When pressurized, the cylinders extend to separate each substructure and raise the telescopic derrick. The casing jack platform comprises a traveling casing jack and spider for holding, inserting and removing tubulars. The base section supports the telescopic derrick and comprises a rotary floor and another spider for holding, inserting and removing tubulars into and from the wellbore. The combination of the traveling spider and stationary spider can be used for inserting tubulars into the wellbore when the well is under pressure.

17 Claims, 4 Drawing Sheets

(56) References Cited

U.S. PATENT DOCUMENTS

| | | | | |
|---|---|---|---|---|
| 6,634,436 | B1 * | 10/2003 | Desai | E21B 7/02 173/1 |
| 7,461,831 | B2 | 12/2008 | Mosley | |
| 7,578,352 | B2 | 8/2009 | Hallonquist et al. | |
| 2009/0283324 | A1 * | 11/2009 | Konduc | E21B 7/023 175/57 |
| 2010/0146873 | A1 | 6/2010 | Keller | |

* cited by examiner

TELESCOPIC MINI-RIG

PRIORITY

This application is a non-provisional application that claims the benefit of U.S. Provisional Patent Application No. 62/051,753, filed Sep. 17, 2014, by David C. Wright, titled "Telescopic Mini-Rig," which is incorporated herein in its entirety by reference.

FIELD

Embodiments usable within the scope of the present disclosure relate, generally, to systems and methods for utilizing telescopic mini-rigs for conducting drilling and wellbore operations, on land or in subsea environments; and more specifically, the make-up and insertion or removal and break-out of tubulars or joints of tubulars using a telescopic derrick system having multiple, nesting substructures that can hydraulically expand and retract into locked positions.

BACKGROUND

In the oil and gas extraction industry, conventional drilling rigs are large, immobile, and often require several days of "rig up" time before commencing operation. In addition, interventions, while wells are under pressure, often require separate snubbing units, usually as part of a specialized "workover" rig, for the make-up and insertion of tubulars into the wellbore. These snubbing units can be attached to a conventional rig, with the drawback of increasing the volume and mass of the rig and increasing the required set-up time.

In response to the need for greater efficiency, portable "mini-rig" designs, which can be transported via trucks, are now common in the industry. These designs offer substantial improvements in terms of efficiency, but have substantial limitations compared to conventional rigs. For instance, many portable rigs are usable for the insertion and removable of smaller drill pipe, but are incapable of handling the larger dimensions of tubulars (e.g., 36-inch diameter casing tubulars). Much of the equipment, such as casing jacks and spiders, have more limited tolerances and weight capacities than traditional rigs, and they generally lack a number of features, such as rotary tables for interfacing with snubbing units.

A need exists for a mini-rig system, which combines the versatility of a conventional rig with a conventional snubbing unit, while still offering the smaller size and quicker set-up advantages of a portable or mini rig design. Embodiments described in the present disclosure meet these needs.

SUMMARY

Embodiments usable within the scope of the present disclosure include a telescoping mini-rig system having a derrick system with a plurality of nested substructures that can expand and retract hydraulically, as needed, by the operator.

The telescopic mini-rig system can comprise a casing jack platform that can comprise a traveling casing jack and traveling spider, which can be used for holding, inserting or removing a tubular or joint of tubulars into or from a wellbore. In addition, the casing jack platform can include a crane winch, wherein the crane winch can be used as draw-works for the at least partially expanded or fully expanded telescopic mini-rig system. The telescopic mini-rig system can further include a second spider that can be located on a rotary floor, located beneath the casing jack platform, for use in holding a tubular or a joint of tubulars that are being inserted into or removed from the wellbore. The telescopic mini-rig can further include a plurality of hydraulic rams that can be usable for lifting or lowering the casing jack platform, in addition to expanding and retracting the plurality of nesting substructures of the telescopic mini-rig system.

DRAWINGS

In the detailed description of various embodiments usable within the scope of the present disclosure, presented below, reference is made to the accompanying drawings, in which.

DETAILED DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Generally, disclosed are methods and systems usable for a telescopic mini-rig ("rig") for conducting drilling and wellbore operations, in which the telescopic mini-rig is constructed on a small scale and comprises the ability to lift, align, and rotate pipe or casing for the make-up and insertion of the pipe or casing, or joints of pipe or casing, into a wellbore as well as the removal and break-out of the pipe or casing from the wellbore. The telescopic mini-rig can be used on land or in subsea environments.

The telescopic mini-rig comprises three main sections, namely, the telescopic derrick section; the casing jack platform section, comprising a traveling casing jack and a spider that can travel with the casing jack and can be usable for holding, inserting and removing tubulars into and from a wellbore; and a base section comprising a rotary floor and spider, wherein the spider can be stationary and usable for holding, inserting and removing tubulars into and form the wellbore.

Figure 2:
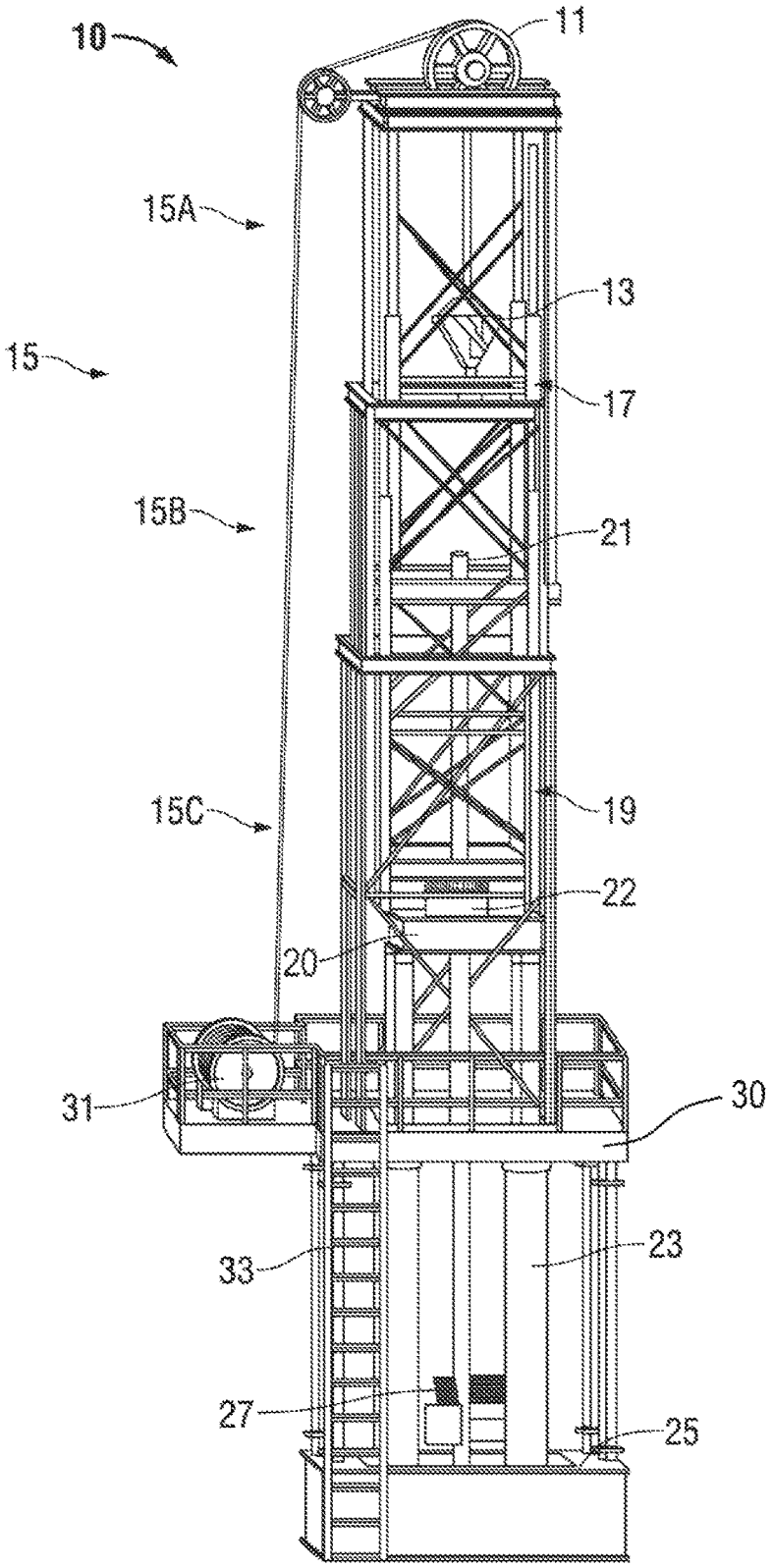
FIG. 2 depicts a front view of an embodiment of a telescoping mini-rig in accordance with the disclosed methods and systems.

The telescopic derrick section comprises at least two U-shaped frame substructures (e.g., see FIG. 2 illustrating substructure 15A, substructure 15B, and substructure 15C), which can be nested together, wherein each substructure can be connected to an adjacent substructure, and each substructure is movable relative to another substructure, by the use of, for example, hydraulic cylinders. In an embodiment of the telescopic derrick section, at each interface of the adjacent substructures is a set of four equidistantly positioned hydraulic rams that can be used to facilitate the expansion and retraction of the adjacent substructures; hence, a telescopic derrick section, having three movable substructures, as shown in FIG. 2, may have two sets of four equidistantly positioned hydraulic rams for movement of the substructures, wherein the first set of hydraulic rams is interiorly located between substructure 15A and substructure 15B, and the second set of hydraulic rams is interiorly located between substructure 15B and substructure 15C as shown in FIG. 2.

Examples of telescopic derrick sections having four or more substructures may similarly exist, and, like the previous example, the hydraulic rams may be set interiorly and/or exteriorly to the substructures. The telescopic derrick section, itself, may be self-contained, and the actuating hydraulic cylinders can be connected to, and located between, the derrick substructures, as described above. The hydraulic cylinders can comprise movable parts, such as pistons, springs, and/or other movable parts for movement of fluids (e.g., air, liquid(s), gas(es), etc.) within the cylinders, for causing the subsequent movement (e.g., expanding and retracting) of the substructures. In addition, when the fluid within the cylinders becomes pressurized, the hydraulic cylinders can function to extend and/or separate each substructure from the other (e.g., adjacent) substructure, thereby raising and fully expanding the derrick structure.

The telescoping of each substructure may occur completely before another substructure telescopes, wherein the separate substructure is fully expanded and locked into place. In an alternative embodiment, the telescoping of more than one substructure may occur, at least partially, such that multiple substructures are expanded and locked into place, simultaneously. After one or more substructures have extended from a fully contracted position(s) to at least a partially or fully extended position(s), each of the one or more extended substructures may be positionally locked into place, with the use of one or more locking mechanism(s). The locking mechanisms can be manually, hydraulically, or otherwise operated, and operation of the locking mechanisms can be conducted from a remote or proximate location to the telescopic derrick section.

The telescopic mini-rig can comprise a casing jack platform section that can include a winch system, wherein the winch system can include a powered cable spool for reeling and unreeling of cable that can be used for the raising and lowering of a traveling block. The cable can extend upward from the winch system (i.e., crane winch) to a crown block, located at the top of the telescopic derrick, and then can extend downward to connect to the traveling block. The traveling block can be connected to other oil and gas equipment (e.g., a top drive and elevator, a swivel) for the lifting and moving of pipe or other tubulars, such as for use during make-up or breakout of a drill string or casing string.

The casing jack platform can include a floor and/or a catwalk for conducting rig-related work by rig operators and other individuals. The casing jack platform can include such oil and gas equipment as a casing jack, a spider, tongs, and other related equipment for use in the handling and rotating of the tubulars. The casing jack can travel up and down within the telescopic derrick and can include a traveling spider that can be used for the lifting or removal of pipe, casing, or other tubulars from the wellbore. The traveling spider can be used in combination with a stationary spider, located on or at the rotary floor, to act as a snubbing unit for the insertion of pipe, casing, or other tubulars into the wellbore, while the well is under pressure.

The winch system can provide an additional lift system, such as, for example, in the use of the crane winch cable lifted traveling block, top drive and elevator system for lifting pipe segments or another tubular from within and/or above the casing jack, for removal of the pipe or other tubular to another location.

The base of the telescopic mini-rig comprises a rotary floor, which can be used to enable the telescopic mini-rig to rotate a pipe segment that may be stuck within the wellbore. In an embodiment, a spider can be located at the rotary floor for gripping and holding a tubular or a string of tubulars, thus preventing the tubular or string of tubulars from falling down the wellbore. In addition, tongs can be used to rotate or torque the pipe or tubular, such as during the insertion into or removal from the wellbore of the pipe or tubular. The base section of the telescopic mini-rig further includes two or more hydraulic cylinders, which can be used for lifting or lowering of the casing jack platform.

Advantages of the systems and methods of the prevent invention include that the telescopic mini-rig can be easily and readily assembled or dissembled for quick and easy transport from one location to another (e.g., by trucking, rail, water or air transport), or from one rig platform to another. Traditional rigs require a minimum of 48-72 hours of set-up time, while the present invention can be assembled after transport in a time frame of 20-36 hours. In addition, the hydraulically powered telescoping features of the telescopic mini-rig save time and money associated with the construction and disassembly of the mini-rig system, in addition to the overall time and cost of the rig operations. The mobility features of the telescopic mini-rig, in addition to minimizing the overall costs of the rig operations, enable the system to be packaged and moved easily, thus eliminating the need to leave behind unused oil and gas equipment in the field. Further, as previously discussed the telescopic mini-rig system includes the operation and functions of a rig and a snubbing unit, which eliminates the need, time, and cost for having to set-up and operate a separate rig system and snubbing unit system.

Figure 1A:
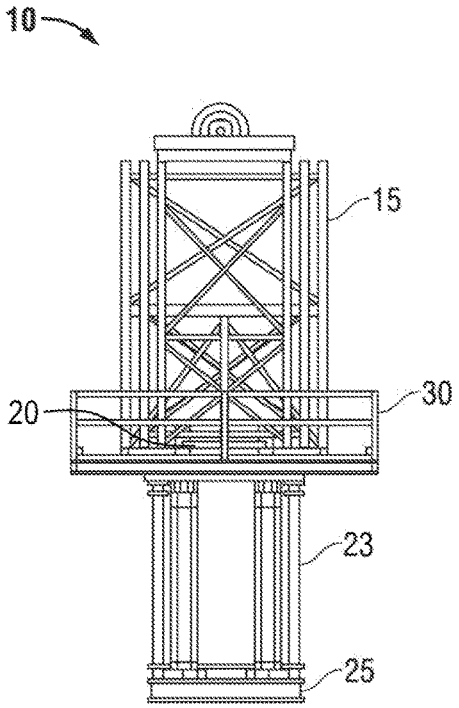
FIG. 1A depicts side-on view of an embodiment of a telescoping mini-rig in accordance with the disclosed methods and systems, wherein the derrick substructures are retracted.
Figure 1B:
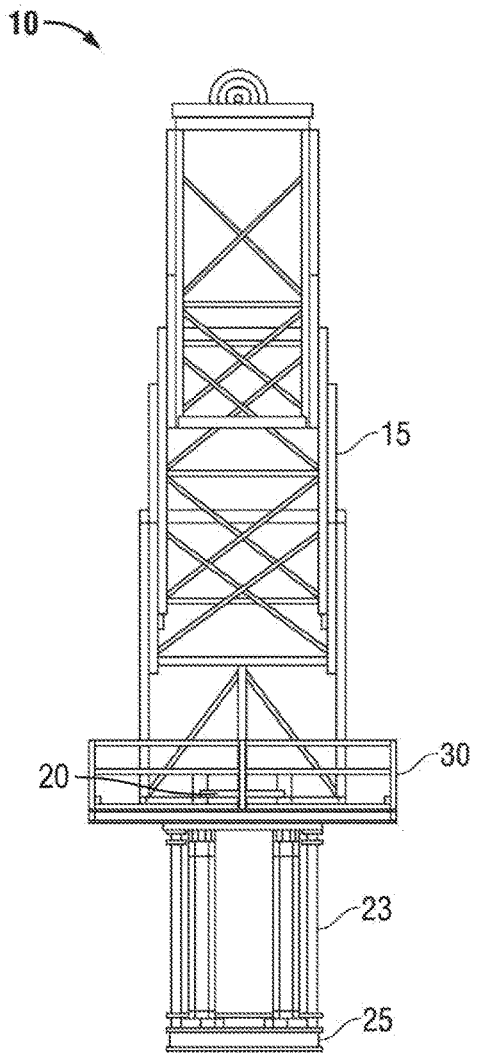
FIG. 1B depicts a side-on view of the embodiment of FIG. 1A, wherein the derrick is extended.
Figure 1C:
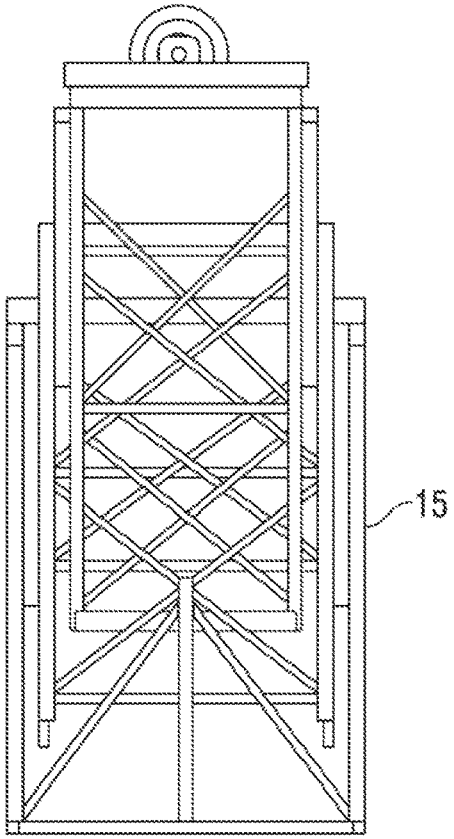
FIG. 1C depicts the derrick substructures of the embodiment of FIG. 1A alone.
Figure 1D:
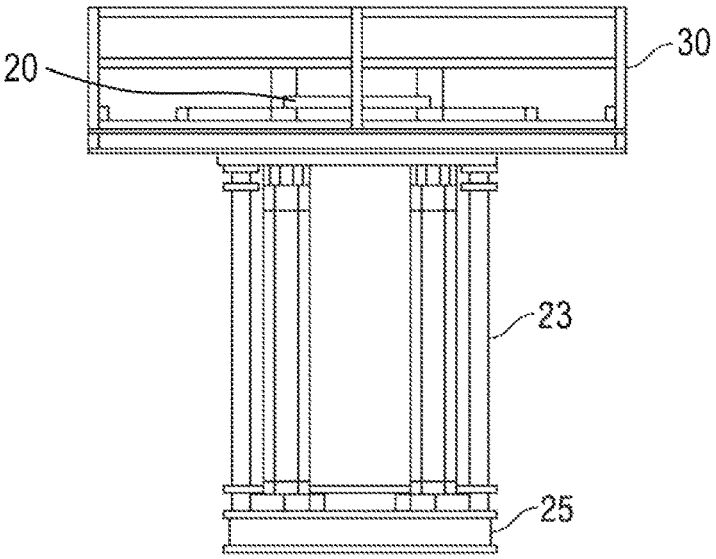
FIG. 1D depicts the base and platform structure of the embodiment in FIG. 1A alone.

Turning now to FIG. 1A-1D, the depicted embodiment is shown via several exemplary views of the telescopic mini-rig 10. In a preferred embodiment, the telescopic mini-rig 10 has a thirty-five foot, telescopic derrick 15. Naturally, in other embodiments, any dimensions may differ. With reference to the left-hand side of FIG. 1C, a front or back view, as the views would be the same, the telescopic derrick 15 is depicted in a retracted state. FIG. 1D depicts a front or back view of a casing jack 20 located on a platform 30 and operably connected to a rotary floor 25, which can have, for example, an 800-ton capacity as shown. Rotary floor 25 also comprises a stationary spider 27 (shown in FIG. 2), while casing jack 20 also comprises a traveling spider 22 (shown in FIG. 2).

FIG. 1A and FIG. 1B are a retracted view and extended view, respectively, of the telescopic mini-rig 10, i.e., the telescopic derrick 15 in a retracted state is atop a casing jack platform 30 or other walkable or non-walkable support structure of the casing jack 20 having a one-thousand ton capacity with an eight-foot max ram jack system that terminates in, and is connected to, a rotary floor 25 having, for example, an 800-ton capacity as shown. In this combination view, the distance between the top of the casing jack 20 and the rotary floor 25 is twelve feet, and the distance between the top of the casing jack 20 and the top of the retracted, telescopic derrick 15 is eighteen feet. In the front view and extended view to form another combination view, the distance between the top of the casing jack 20 and the top of the retracted, telescopic derrick 15 is thirty-five feet, demonstrating the compact size of the features of the telescopic mini-rig 10. As stated above, however, the telescopic mini-rig 10 can be constructed with features of varying dimensions and sizes.

FIG. 2 shows an example of the telescopic mini-rig 10 in an expanded state that is thirty-five feet above the casing jack platform 30 (e.g., monkey board) with the telescopic derrick 15 that collectively includes three nesting substructures, namely 15A, 15B, and 15C. Each of these substructures 15A, 15B, and 15C optionally has supporting structures, such as the depicted crossbeams, to provide additional integrity to each substructure (e.g., 15A, 15B, 15C, etc.) comprising the derrick 15, which, like the telescopic mini-rig 10, is also made from materials sufficient to withstand pernicious land and/or subsea environments. The derrick 15, as shown, includes a winch system having a powered crane winch 31 for draw-works, which is in communication with a crown block 11 on top of the derrick 15, and a 35-ton hook traveling block 13, which may be used in combination with a non-depicted top-drive and elevator to pick-up, lift, and rotate a pipe or other tubular, such as for use during make-up or breakout of a drillstring 21.

As previously discussed, FIG. 2 also shows a first set 17 of hydraulic rams interiorly and equidistantly located between substructures 15A and 15B, and a second set 19 of hydraulic rams interiorly and equidistantly located between substructures 15B and 15C. In other non-depicted, example embodiments, the substructures (e.g., 15A, 15B, 15C, etc.) may have more or less than four hydraulic rams. Further, the rams may be positioned differently relative to each other. Further still, each of the rams on a substructure may be set interiorly, exteriorly, and/or in a combination thereof. When the telescopic derrick's 15 substructures 15A, 15B, 15C are in a desired position, i.e., a state of at least partial expansion or retraction, then locking mechanism(s), which are local to each substructure, can be used to retain said desired state of the substructures. The proximately or remotely actuated locking mechanism(s) can be reversible and can be operated hydraulically, manually, or otherwise.

Moving on to the embodiment depicted in FIG. 2 of the telescopic mini-rig, a drillpipe 21, that may be, for example, undergoing make-up or break-out, extends through a traveling spider 22 located atop a traveling casing jack 20 having, for example, a 1000-ton capacity. The drillpipe 21 extends through the casing jack 20 and casing jack platform 30. In the depicted embodiment, a crane winch 31 and ladder 33 are attached to the casing jack platform 30. As shown, the casing jack 20 and its 20 hydraulic rams 23 have an eight feet extension capability in this embodiment, and culminates in a 800-ton rotary floor 25 topped by another spider 27 (e.g., stationary spider), which, like the traveling spider 22, may have slips for holding tubulars, such as the drillstring 21, and can be positioned adjacent to tongs for rotating a tubular(s).

The spiders 22 and 27, combined with the casing jack 20 and the rotary floor 25, have the capacity to handle large tubulars that conventional portable rigs are not capable of running, e.g., 36" casing tubulars.

Figure 3:
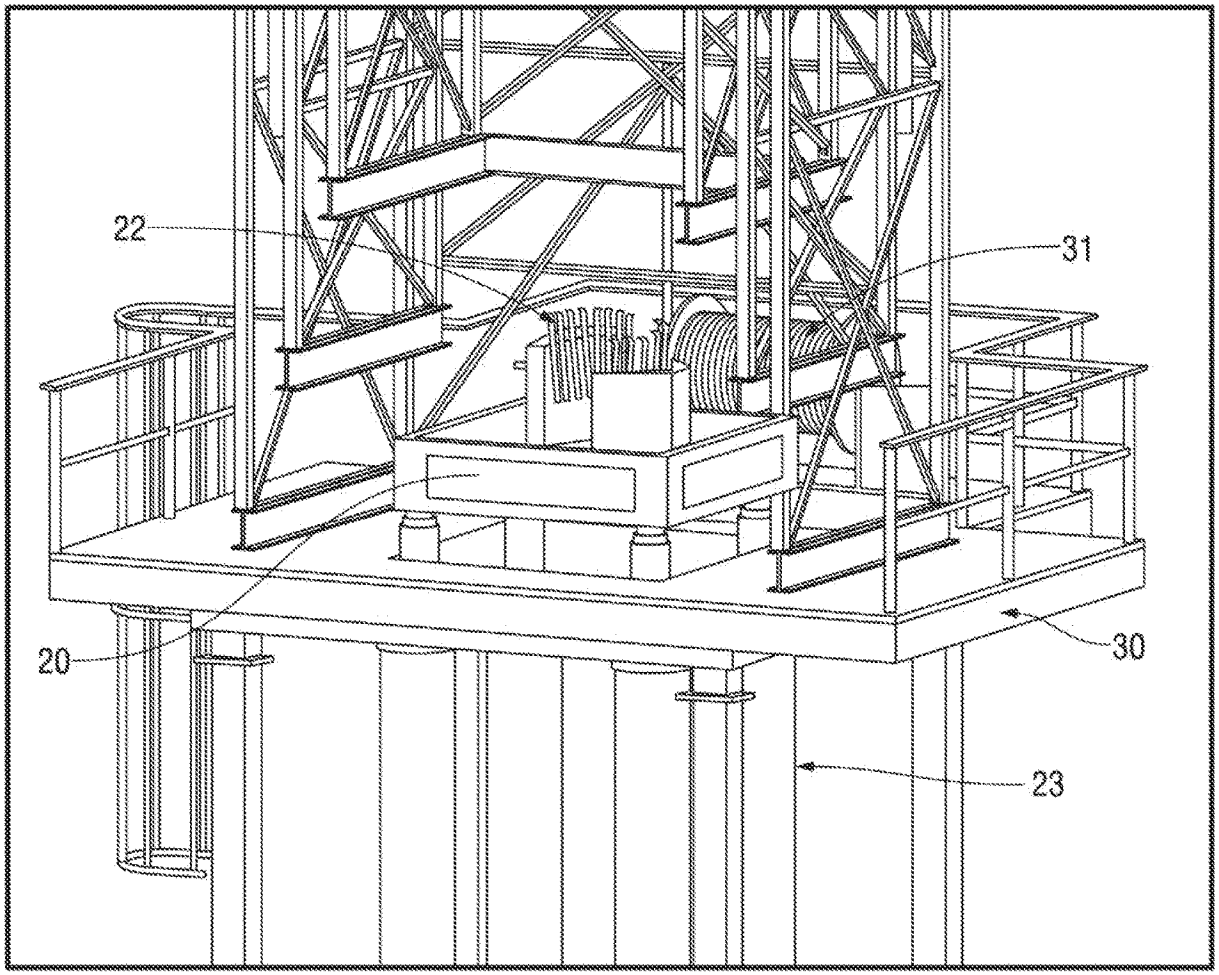
FIG. 3 depicts an exploded view of features of an embodiment relative to the casing jack platform in accordance with the disclosed methods and systems.

Turning now to FIG. 3, an exploded view of features of the telescopic mini-rig, relative to the casing jack platform 30 (as shown on FIG. 2), is depicted. FIG. 3 shows the crane winch 31 on the casing jack platform 20, with a casing jack 20 having a spider 22 in an opened position (e.g., slips of spider are opened and are not gripping a tubular). Beneath the casing jack 20, which is in a slightly elevated state relative to the level of the casing jack platform 30, is a hydraulic ram 23 (or set thereof as depicted) that enables elevation of the casing jack 20. In the example, the hydraulic ram(s) 23 provide for an elevation capability of eight feet. In other embodiments, one or more rams 23 provide for greater or less elevation capabilities.

Various embodiments, usable within the scope of the present disclosure, have been described with emphasis and these embodiments can be practiced separately or in various combinations thereof. In addition, it should be understood that within the scope of the appended claims, the present invention can be practiced other than as specifically described herein.

What is claimed is:

1. A mini rig system comprising:

a base, wherein the base comprises a rotary floor and a first spider above the rotary floor;

a platform located above and connected to the base, wherein the platform comprises a casing jack and a second spider;

a derrick located above and connected to said platform, wherein the derrick comprises a first substructure, a second substructure, a third substructure, and a first and second pair of hydraulic rams; and a third pair of hydraulic rams located between the base and the platform, wherein the first pair of hydraulic rams acts to extend and retract the third substructure, wherein the second pair of hydraulic rams acts to extend and retract the second substructure, and wherein the third pair of hydraulic rams acts to extend and retract the casing jack and second spider within the derrick.

2. The system of claim 1, wherein the third pair of hydraulic rams and the casing jack have a weight capacity of at least 1,000 tons.

3. The system of claim 1, wherein the rotary floor has a capacity of at least 800 tons.

4. The system of claim 1, wherein one or more of the first substructure, the second substructure, or the third substructure further comprises a supporting structure.

5. The system of claim 1, wherein the third substructure is internal to the second substructure when in the retracted position, and wherein the second substructure is internal to the first substructure when in the retracted position.

6. The system of claim 5, wherein the first pair of hydraulic rams are located between the second and third substructure, and wherein the second pair of hydraulic rams are located between the first and second substructure.

7. The system of claim 1, wherein the first spider is stationary, and wherein the second spider travels with the casing jack.

8. The system of claim 7, wherein the first and second spiders are concentric.

9. The system of claim 1, wherein the platform further comprises a crane winch.

10. The system of claim 9, wherein the third substructure further comprises a crown block in communication with the crane winch.

11. The system of claim 10, further comprising a traveling block in communication with the crown block.

12. A method of moving pipe into or out of a drill string, the method comprising:

positioning a platform having a base and a telescoping derrick comprising a plurality of nested substructures above a wellbore;

extending a first set of hydraulic cylinders and raising a first substructure out of the plurality of substructures;

extending a second set of hydraulic cylinders and raising a second substructure of the plurality of substructures, wherein extending the second substructure further raises the first substructure;

lifting one or more sections of pipe through the base and into the platform and telescoping derrick by utilizing a draw works, crane winch, crown block, traveling block, or combinations thereof;

extending, with a third set of hydraulic cylinders between the base and platform, a casing lack and traveling spider within the derrick to receive the one or more sections of pipe; and inserting, with the traveling spider and casing jack, the one or more sections of pipe into the wellbore by retracting the third set of hydraulic cylinders.

13. The method of claim 12, wherein the step of extending the second set of hydraulic cylinders takes place after the step of extending the first set of hydraulic cylinders.

14. The method of claim 12, wherein the step of extending the first set of hydraulic cylinders takes place simultaneously with the step of extending the second set of hydraulic cylinders.

15. The method of claim 12, further comprising the step of actuating a first locking mechanism after extending the first set of hydraulic cylinders, and actuating a second locking mechanism after extending the second set of hydraulic cylinders.

16. The method of claim 12, further comprising, subsequent to the lifting, rotating the pipe for make-up or break-out through use of the traveling spider and a stationary spider.

17. The method of claim 12, wherein the step of inserting the one or more sections of pipe into the wellbore occurs when the wellbore pressure is under-balanced or over-balanced.

* * * * *